United States Patent [19]

Morita et al.

[11] Patent Number: 4,859,381

[45] Date of Patent: Aug. 22, 1989

[54] PROCESS FOR PREPARING PITCH-TYPE CARBON FIBERS

[75] Inventors: Hiroaki Morita, Osaka; Kazutoshi Haraguchi, Matsudo; Eiji Tanigawa, Kawanishi, all of Japan

[73] Assignees: Osaka Gas Company Limited, Osaka; Dainippon Ink and Chemicals Inc., Tokyo, both of Japan

[21] Appl. No.: 105,428

[22] PCT Filed: Jan. 22, 1987

[86] PCT No.: PCT/JP87/00041

§ 371 Date: Nov. 18, 1987

§ 102(e) Date: Nov. 18, 1987

[30] Foreign Application Priority Data

Jan. 22, 1986 [JP] Japan ..... 61-12848

[51] Int. Cl.[4] ..... D01F 9/00

[52] U.S. Cl. ..... 264/29.2; 264/83; 264/177.11; 264/177.13; 264/177.18; 264/177.19; 264/211.11; 264/211.15; 264/211.17

[58] Field of Search ..... 264/29.2, 83, 177.11, 264/177.13, 177.18, 177.19, 211.11, 211.15, 211.17

[56] References Cited

FOREIGN PATENT DOCUMENTS 59-168127 9/1984 Japan .
60-194120 10/1985 Japan .
60-239520 11/1985 Japan .
60-252723 12/1985 Japan .

*Primary Examiner*—Hubert Lorin
*Attorney, Agent, or Firm*—Armstrong, Nikaido, Marmelstein, Kubovcik & Murray

[57] ABSTRACT

A process for preparing pitch-type carbon fibers by melt-spinning a pitch-type material, rendering the material infusible and carbonizing it, characterized by the steps of passing molten pitch, before reaching the final nozzle, through a capillary portion of circular, otherwise shaped, or slit type to thereby apply a shearing stress at least ½ as high as the level of shearing stress to be exerted during the passage through the final nozzle orifice, maintaining the molten pitch in a state substantially free of shearing stress and then passing the pitch through the nozzle orifice for spinning.

10 Claims, 4 Drawing Sheets

PROCESS FOR PREPARING PITCH-TYPE CARBON FIBERS

TECHNICAL FIELD

This invention relates to a process for preparing pitch-type carbon fibers.

BACKGROUND ART

Because carbon fibers prepared from pitch-type materials involve lower production costs than carbon fibers produced from organic synthetic fibers such as polyacrylonitrile as a precursor and because articles of high elastic modulus can be easily produced from the pitch-type carbon fibers, it is expected that pitch-type carbon fibers can be less expensive then high-performance materials. However, commercially available pitch-type carbon fibers have a tensile strength of not more than about 200 kg/mm$^2$ and poor quality stability, hence not satisfactory.

Generally the cohesion stage of molecules in section of pitch-type carbon fibers (hereinafter referred to as high-order sectional structure) widely varies with spinning conditions. More specifically, this structure is basically classified into the type in which molecules form crystals along the concentric circles of fiber (so-called onion type), the type in which molecules form crystals radially of center of fiber (radial type), and the type in which molecules are randomly distributed without orientation (random type). Yet there actually exist fibers having a structure of mixtures of these types. Further, flaws such as longitudinal fractures, cracks, voids and the like may exist in part or whole of the fibers. Accordingly the high-order sectional structures of pitch-type carbon fibers including such flaws are complicated and abundantly various. The presence of various flaws and high-order sectional structures is one of the main causes of lowering the quality stability of pitch-type carbon fibers.

While depending on the properties of pitch for use in spinning, the occurrence of the above-mentioned flaws and the formation of high-order sectional structures are most greatly affected and varied by the spinning conditions. Accordingly, in order to improve the quality and stability of carbon fibers, it is necessary to establish spinning techniques capable of invariable producing carbon fibers substantially free of flaws and having a specific high-order sectional structure even if these are some irregularities in properties of pitch for spinning. In other words, techniques are required for stably forming the onion type and/or random type of high-order sectional structures which are effective in exhibiting a high tensile strength without creating flaws such as longitudinal fractures, cracks, voids or the like.

DISCLOSURE OF THE INVENTION

In view of the above-mentioned state of the art, we conducted extensive research and found that when during melt-spinning operation, a molten pitch-type material, prior to passage through the final nozzle orifice, is passed through a capillary portion having specific shape to thereby exert a shearing stress exceeding a specific value on the material, then temporarily maintained in a state particularly free of shearing stress, and passed through the nozzle orifice for spinning, the problems arising from the conventional techniques can be practically obviated or alleviated to a great extent. The present invention provides a process for preparing pitch-type carbon fibers by melt-spinning a pitch-type material, rendering the material infusible and carbonizing it, characterized by the steps of passing molten pitch, before reaching the final nozzle, through a capillary portion of circular, otherwise shaped, or slit type to thereby apply a shearing stress at least $\frac{1}{2}$ as high as the level of shearing stress to exerted during the passage through the final nozzle orifice, maintaining the molten pitch in a state substantially free of shearing stress and then passing the pitch through the nozzle orifice for spinning.

According to the present invention, when the pitch is graphitized in the carbonization step described above, a graphite fiber can be produced. The term "carbonization" in the specification refers also to graphitization and term "carbon fibers" is intended to encompass graphite fibers.

It is critical in the present invention to pass a molten pitch-type material, prior to treatment in the final nozzle, through a capillary portion of circular, non-circularly shaped, or slit type to thereby apply a shearing stress equal to at least $\frac{1}{2}$ times, preferably $\frac{1}{2}$ to 10 times the shearing stress to be given by the passage through the nozzle orifice, temporarily maintaining the molten pitch in a state partically free of shearing stress and passing the pitch through the final nozzle orifice for spinning. If shearing stress applied in the capillary portion is less than $\frac{1}{2}$ the shearing stress imposed by the passage through the final nozzle, the desired result can not be fully achieved. If shearing stress is applied by passing the material through other means that the capillary means, e.g. through the clearances of densely packed fillers, the desired result can not be obtained. Further, when shearing stress is imposed on the molten pitch-type material in the capillary portion and immediately spun through the final nozzle orifice without bringing the material to a state practically free of shearing stress, the effect of the invention can not be attained, either. The sectional shape of the capillary portion to be used in the invention can be any of circular shape, slit shape (or rectangular) and other non-circular shapes (e.g., square, cruciform, Y-shaped and otherwise shaped). The cross-sectional area of capillary portion and the length thereof are not specifically limited insofar as they are sufficient to apply the required level of shearing stress. Nevertheless usually the cross-sectional area thereof is about $5\times10^{-3}$ to about $5\times10^{-1}$ mm$^2$ and the length thereof is about 0.1 to about 3.0 mm. The cross-sectional area referred to herein is intended to mean the total cross-sectional area of the openings of the capillary portion.

The time for maintaining the molten pitch in a state substantially free of shearing stress between the capillary portion and the final nozzle is variable depending on the kind and properties of pitch used, spinning temperature, discharge of pitch per unit time, shapes of the capillary portion and nozzle orifices, etc. and is not specifically limited. Usually the time therefor is preferred it is about $10^3$ to about $10^5$ times the time usually required for the molten pitch to pass through the capillary portion. In order to hold the molten pitch free of shearing stress between the capillary portion and the final nozzle orifice, an intermediate portion therebetween is made hollow so that no shearing stress is applied to the material except in the outer walls of packed filler and/or the guide bore of nozzle.

The pitch to be used for spinning in the invention can be prepared by thermal condensation polymerization of pitch material in a stream of inert gas. Useful pitch materials can be any of petroleum pitch, coal pitch, residual pitch resulting from the thermal decomposition of organic compound and the like. Preferred pitch materials are those having a softening point of 280° to 325° C. ( as measured by a softening point-measuring device of Metller Co., Switzerland). Particularly when coal pitch such as coal tar or coal tar pitch is used as a starting material, the spinning capability can be further improved by heat-treating the starting pitch at a temperature of 350° to 500° in the presence of aromatic reducing solvent prior to thermal condensation polymerization according to the method disclosed in Japanese Unexamined Patent Publication No. 88016/1982. The pitch, however, for use with spinning is not specifically limited if it can be spun.

There is no specific limitation on the cross-sectional area of final nozzle orifice to be used in the present invention. It is usually about $5\times10^{-3}$ to $10^{-1}$ mm$^2$.

In the present invention, the pitch fiber thus obtained is processed into carbon fiber by conventional methods, for example, by being made infusible at about 300° to about 340° C. in an oxygen atmosphere, and heated to about 1000° to about 2000° C. in an atmosphere of nitrogen, carbon dioxide, argon or the like for carbonization or to about 2000° to about 300° C. in argon for graphitization.

Figure 1A:
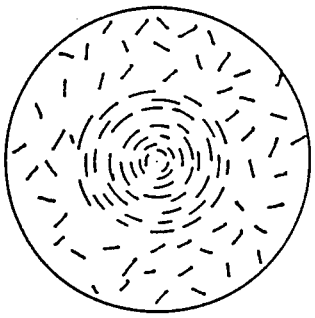
FIGS. 1 and 2 are schematic views showing the high-order sectional structure of the carbon fiber obtained by the process of the present invention.
Figure 1B:
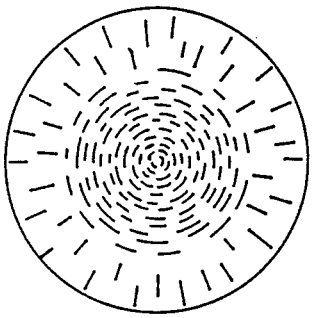
Figure 2:
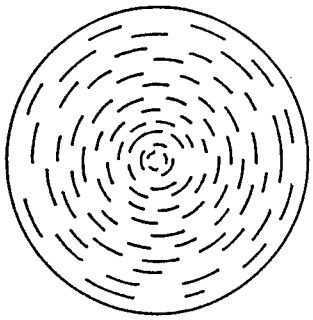

The high-order sectional structures of carbon fibers prepared according to the present invention are partly or wholly of the onion-type (see FIGS. 1 and 2). When the structure is partly of the onion-type, the onion-type exists in the interior layers and the random-type (FIG. 1(*a*)) or radial-type (FIG. 1(*b*)) are found in the exterior layers.

The shearing stress was measured according to the effective shearing stress ($\tau_w$=dyne/cm$^2$) on the wall surface of the capillary portion of nozzle when the molten pitch is passed through the capillary portion or the nozzle, the effective shearing stress being given by the following equation:

$$\tau_w = Pr/2\,l$$

wherein P is the pressure differential (dyne/cm$^2$), l is the effective length (cm) of the capillary or nozzle, and r is the radius (cm) of the capillary or nozzle.

EFFECTS OF THE INVENTION

According to the present invention, the following effects can be accomplished.

(i) The finished carbon fibers obtained are substantially free of microscopic flaw in the interior thereof such as longitudinal fracture, crack, void or the like.

(ii) The carbon fibers obtained are so high in quality stability that the fibers have a stable high-order sectional structure of the onion-type at least partly in section, even if there is a fluctuation of the properties of the starting pitch material.

(iii) As a result of the advantages (i) and (ii), the carbon fibers are given a significantly improved tensile strength.

(iv) In addition, when a nozzle having a multiplicity of holes is used, the frequency of thread breakage is diminished, thereby enabling stable, continuous spinning operaton.

(v) A carbon fiber can be prepared which has the onion-type structure in the interior thereof with the surface variable into the onion-, random- or radial-type. Therefore it is possible to select various molecular arrangements in the surface with a favorable adhesion to the resin and the carbon in the resin composite and carbon composite while retaining stable dynamic properties of carbon fiber.

The invention will be explained below with reference to the following examples together with reference and comparison examples.

REFERENCE EXAMPLE 1

A mixed solution of 1 part by weight of coal tar pitch having a softening point of 110° C. and containing 0.18% of quinoline-insoluble component and 35% of benzene-insoluble component and 2 parts by weight of hydrogenated heavy antracene oil was heated with stirring in an autoclave at 430° C. for 60 minutes, then the hot mixture was passed through a filter-press. The hydrogenated heavy anthracene oil was removed from the filtrate under reduced pressure at 300° C. to obtain reduced pitch.

In a reactor equipped with a gas-inlet pipe, a thermocouple, a stirrer and a distillate-outlet pipe was placed 50 Kg of reduced pitch obtained above. The reduced pitch was treated at 410° to 480° C. while introducing nitrogen gas to effect removal of low-molecular weight components and condensation polymerization. By selecting proper reaction time and temperature, two kinds of heat condensation polymerized pitch were produced, and the properties thereof are shown in Table 1 as Samples Nos. 1 to 2.

REFERENCE EXAMPLE 2

A coal tar pitch similar to that used in Reference Example 1 was subjected to heat condensation polymerization in the same way as described in Reference Example 1 except that the heat treatment of the coal tar pitch as mixted with hydrogenated heavy anthracene oil was not conducted. The properties of the resultant heat condensation polymerized pitch are shown in Table 1 as Sample No. 3.

TABLE 1

| Heat condensation polymerized pitch | QI (wt. %) | BI (wt. %) | Softening point (°C.) |
|---|---|---|---|
| No. 1 | 35 | 95 | 318 |
| No. 2 | 22 | 93 | 313 |
| No. 3 | 40 | 92 | 315 |

Note:
Softening point was determined by a softening point measuring device manufactured by Metller Co., Switzerland.

EXAMPLES 1 TO 3

Using a spinning apparatus equipped with capillary portion consisting of 100 fine pipes of 0.15 mm in diameter and 0.4 mm in length (total cross-sectional area: 1.77

$mm^2$), stress relaxation part of 15 $cm^3$ in volume and a spinneret having 100 spinning holes, the heat condensation polymerized pitch Samples Nos. 1 to 3 obtained in Reference Examples 1 and 2 were spun.

During the spinning operation, the pitch was subjected at the capillary portion to a shearing stress of about 250% of that to be applied at the final nozzle orifice, then brought to a state free of shearing stress by stress relaxation and again subjected to a shearing stress at the final nozzle holes.

The pitch fibers thus produced were subjected to a treatment in air at 300° C. for 30 minutes, thereby rendered infusible and then heated to 1200° C. in $N_2$ gas atmosphere to produce carbon fibers.

Table 2 shows the high-order sectional structure and flaw content of the fibers obtained above and the average time (hr) during which pitch fibers of 10 μm in diameter can be spun continuously without breaking.

TABLE 2

| Ex. | Heat condensation polymerized pitch | Continuous spinning (hr) | High-order sectional structure | Flaw content (%) |
|---|---|---|---|---|
| 1 | No. 1 | 2.5 | onion type | 0 |
| 2 | No. 2 | 1.8 | inner layer onion type outer layer random-radial type | 0 |
| 3 | No. 3 | 1.2 | inner layer onion type outer layer random type | 3 |

Figure 3:
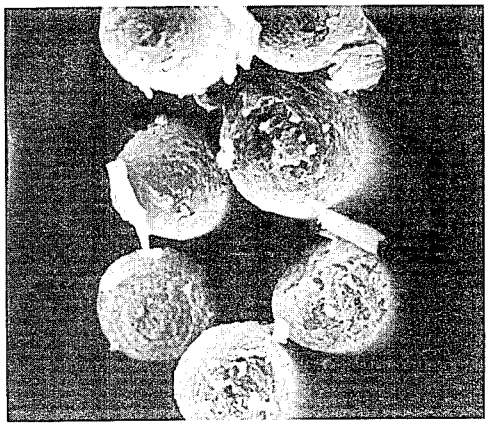
FIGS. 3 to 5 are scanning electron micrographs showing the high-order sectional structures of carbon fibers prepared in Examples 1, 2 and 3.
Figure 4:
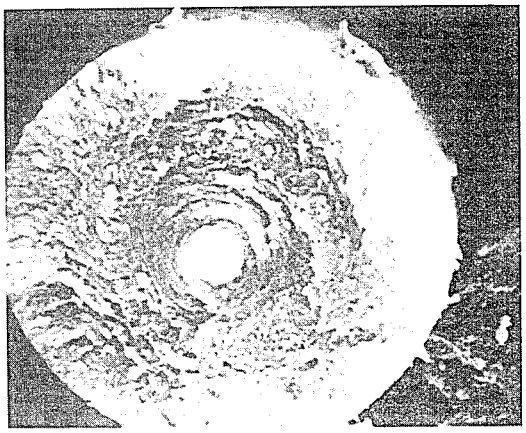
Figure 5:
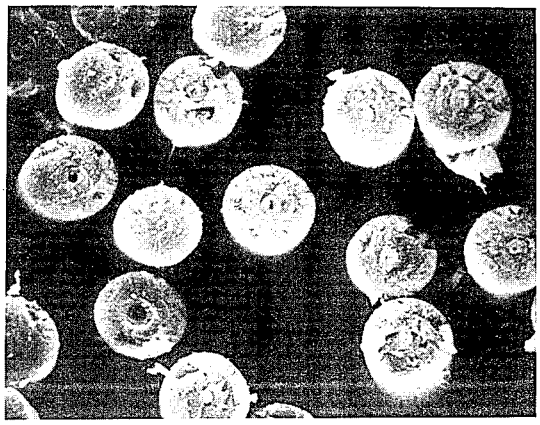

FIG. 3 (about 2600× magnification), FIG. 4 (about 8000× magnification) and FIG. 5 (about 1700× magnification) show scanning electron micrographs indicating the high-order sectional structures of the carbon fibers obtained in Examples 1, 2 and 3, respectively.

EXAMPLES 4 TO 6

The heat condensation polymerized pitch No. 1 obtained in Reference Example 1 was spun with use of a spinning apparatus comprising a capillary portion having the shape, number, total cross-sectional area and shearing stress as listed in Table 3, a stress relaxation part of about 18 $cm^3$ in volume and spinneret of 0.2 mm in diameter and 0.4 mm in length (100 holes). The resultant pitch fibers were subjected to treatment for rendering them infusible and carbonization treatment in the same manner as in Examples 1 to 3 to produce carbon fibers.

The high-order sectional structure and flaw content of the carbon fibers thus produced are shown in Table 3.

TABLE 3

| | Capillary portion | | | | | |
|---|---|---|---|---|---|---|
| Ex. | shape | number | Total cross sectional area ($mm^2$) | Rate of shearing stress (%, relative to nozzle) | High-order sectional structure | Flaw content (%) |
| 4 | ellipse long axis 0.25 mm short axis 0.13 mm | 50 | 1.28 | about 400% | inner layer onion type outer layer random type | 0 |
| 5 | equilateral triangle (side length 0.2 mm) | 70 | 1.21 | about 450% | inner layer onion type outer layer radial type | 4 |
| 6 | slit width 0.3 mm height 0.1 mm | 30 | 0.9 | about 600% | inner layer onion type outer layer radial type | 2 |

It is apparent that carbon fibers having few flaws and a high-order sectional structure of onion-type in the inner layer can be obtained, even when the spinning apparatus having capillary section of non-circular shape.

COMPARISON EXAMPLES 1 TO 3

With use of a spinning apparatus comprising a spinneret of 0.2 mm in diameter and 0.4 mm in length (100 holes), the heat condensation polymerized pitch samples Nos. 1 to 3 obtained in Reference Examples 1 and 2 were spun and then subjected to the treatment for rendering them infusible and carbonization treatment under the same conditions as in Examples 1 to 3.

Table 4 shows the high-order sectional structure and flaw content of the carbon fibers obtained and also average time (hr) during which pitch fibers of 10 μm in diameter can be spun continuously without breakage.

COMPARISON EXAMPLE 4

The heat condensation polymerized pitch No. 1 was spun with use of the same spinning apparatus as used in Example 1 except that the capillary portion has dimensions of 0.3 mm in diameter and 0.6 mm in length (100 tubes). During the spinning operation, the pitch was subjected at the capillary portion to a shearing stress of about 30% of that applied at the final nozzle holes. The resulting pitch fibers were subjected, under the same conditions as in Example 1, to the treatment for rendering them infusible and carbonization treatment to produce carbon fibers.

The high-order sectional structure and flaw content of the carbon fibers are shown in Table 4.

Figure 6:
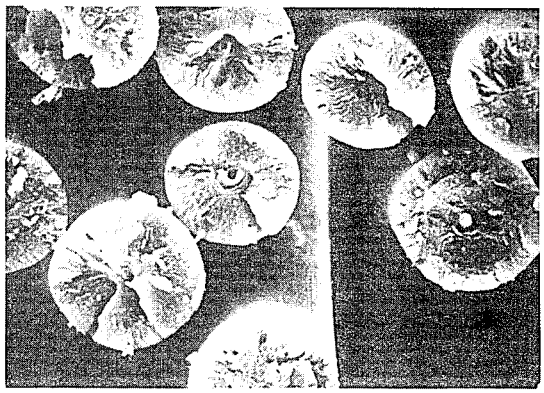
FIGS. 6 and 7 are scanning electron micrographs showing the high-order sectional structures of carbon fibers prepared in Comparison Examples 4 and 5.

FIG. 6 shows a scanning electron micrograph (about 2800× magnification) of the carbon fibers obtained in this Comparison Example.

COMPARISON EXAMPLE 5

The heat condensation polymerized pitch No. 1 obtained in Reference Example 1 was spun with use of a spinning apparatus comprising a capillary portion consisting of 100 fine tubes of 0.15 mm in diameter and 0.4 mm in length (100 nozzle holes) and a nozzle portion of 0.2 mm in diameter and 0.4 mm in length wherein the two portions were substantially directly connected. During the spinning operation the pitch was subjected at the capillary portion to a shearing stress of about250% of that to be applied at the final spinning holes, and immediately thereafter was subjected to the shearing stress at the final spinning holes.

The resultant pitch fibers were subjected to the treatment for rendering them infusible and carbonization treatment in the same manner as in Examples 1 to 3 to produce carbon fibers.

Table 4 shows the high-order sectional structure and flaw content of the carbon fibers.

Figure 7:
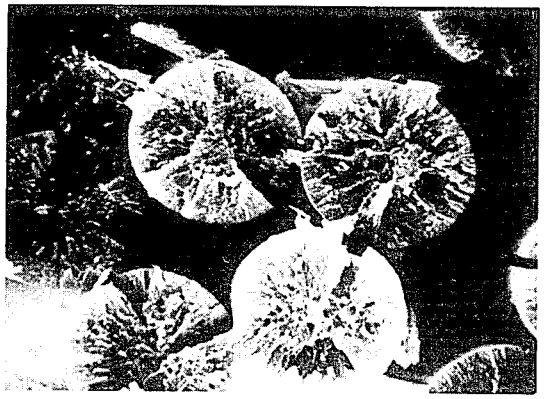

FIG. 7 shows a scanning electron micrograph (about 400× magnification) exhibiting the high-order sectional structure of the carbon fibers obtained in this Comparison Example.

TABLE 4

| Comp. Ex. | Heat condensation polymerized pitch | Continuous spinning (hr) | High-order sectional structure | Flaw content (%) |
|---|---|---|---|---|
| 1 | No. 1 | 2.2 | radial type | 30 |
| 2 | No. 2 | 0.7 | radial type | 40 |
| 3 | No. 3 | 0.3 | radial type | 70 |
| 4 | No. 1 | — | inner layer onion type outer layer radial type | 60 |
| 5 | No. 1 | — | radial type | 90 |

It is apparent from comparison of the results from Examples 1 to 3 as shown in Table 2 with those from Comparison Examples 1 to 3 as given in Table 4 that the use of spinning apparatus having no capillary portion nor stress relaxation part gives good spinning continuity and yields carbon fibers having high-order sectional structure of radial type and high flaw content even if the same starting pitch is used.

Comparing the results from Example 1 as shown in Table 2 and those from Comparison Example 4 as shown in Table 4, it is apparent that higher content of flaws, such as longitudinal fracture, cracks, etc., are given when the pitch was subjected at the capillary portion to a shearing stress of less than one half of that given at the final nozzle holes.

Further, comparison of the results from Example 1 as shown in Table 2 with those from Comparison Example 5 as shown in Table 4 reveals that the use of a spinning apparatus having no stress relaxation part between the capillary portion and the final nozzle portion also yields carbon fibers having a high-order sectional structure of radial type and high flaw content.

We claim:

1. A process for preparing pitch-type carbon fibers exhibiting a high tensile strength and substantially free of flaws by melt-spinning a pitch-type material into a fiber, rendering the fiber infusible and then carbonizing said fiber, comprising the steps of passing molten pitch, before reaching a final nozzle orifice, through a capillary portion having a circular, non-circular, or slit type sectional shape to thereby apply a shearing stress of at least ½ as high as the level of shearing stress to be exerted during passage through the final nozzle orifice and then maintaining the molten pitch for a time in a state substantially free of shearing stress, and then passing the pitch through the final nozzle orifice to spin said pitch into a fiber.

2. A process according to claim 1 wherein the length of the capillary portion is 0.1 to 3.0 mm.

3. A process according to claim 1 wherein the cross-sectonal area of the capillary portion is $5\times10^{-3}$ to $5\times10^{-1}$ mm$^2$.

4. A process according to claim 1 wherein the shearing stress applied to the capillary portion is ½ to 10 times the shearing stress applied in the final nozzle orifice.

5. A process according to claim 1 wherein the softening point of the molten pitch is 280° to 325° C.

6. A process for preparing a pitch-type graphite fiber exhibiting a high tensile strength and substantially free of flaws comprising the steps of melting a pitch-type material, spinning the molten material to a fiber, rendering the fiber infusible and then graphitizing said fiber, the process comprising the steps of passing the molten pitch, before reaching a final nozzle orifice, through a capillary portion having a circular, non-circular, or slit type sectional shape to thereby apply a shearing stress of at least ½ as high as the shearing stress to be exerted during passage of the pitch through the final nozzle orifice and then maintaining the molten pitch for a time in a state free of shearing stress, and passing the pitch through the final nozzle orifice to spin said pitch into a fiber.

7. A process according to claim 6 wherein the length of the capillary portion is 0.1 to 3.0 mm.

8. A portion according to claim 6 wherein the cross-sectional area of the capillary portion is $5\times10^{-3}$ to $5\times10^{-1}$ mm$^2$.

9. A process according to claim 6 wherein the shearing stress applied in the capillary portion is ½ to 10 times the shearing stress applied in the final nozzle orifice.

10. A process according to claim 6 wherein the softening point of the molten pitch is 280° to 325° C.

* * * * *